US010578359B2

(12) United States Patent
Durance et al.

(10) Patent No.: US 10,578,359 B2
(45) **Date of Patent: *Mar. 3, 2020**

(54) MICROWAVE VACUUM-DRYING OF ORGANIC MATERIALS

(71) Applicant: ENWAVE CORPORATION, Delta (CA)

(72) Inventors: Timothy D. Durance, Vancouver (CA); Jun Fu, Port Coquitlam (CA)

(73) Assignee: ENWAVE CORPORATION, British Columbia (CA)

( * ) Notice: Subject to any disclaimer, the term of this patent is extended or adjusted under 35 U.S.C. 154(b) by 703 days.

This patent is subject to a terminal disclaimer.

(21) Appl. No.: 15/313,390

(22) PCT Filed: Jun. 11, 2014

(86) PCT No.: PCT/CA2014/050545

§ 371 (c)(1),
(2) Date: Nov. 22, 2016

(87) PCT Pub. No.: WO2015/188248

PCT Pub. Date: Dec. 17, 2015

(65) Prior Publication Data

US 2017/0115057 A1 Apr. 27, 2017

(51) Int. Cl.
*H05B 6/70* (2006.01)
*F26B 3/347* (2006.01)
(Continued)

(52) U.S. Cl.
CPC ..... *F26B 3/347* (2013.01); *F26B 5/04* (2013.01); *F26B 5/042* (2013.01); *F26B 5/048* (2013.01)

(58) Field of Classification Search
CPC .... F26B 3/28; F26B 3/347; F26B 5/04; F26B 5/041; F26B 5/042; F26B 5/048;
(Continued)

(56) References Cited

U.S. PATENT DOCUMENTS 3,276,138 A 10/1966 Fritz
4,045,639 A 8/1977 Meisel
(Continued)

FOREIGN PATENT DOCUMENTS

CA 2818377 A1 6/2014
WO 2007038196 A2 4/2007
(Continued)

OTHER PUBLICATIONS

International Searching Authority, "Search Report," issued in connection with International Application No. PCT/CA2014/050545, dated Dec. 17, 2105, 4 pages.

*Primary Examiner* — Hung D Nguyen
(74) *Attorney, Agent, or Firm* — Nyemaster Goode P.C.

(57) ABSTRACT

An apparatus and method for microwave vacuum-drying of organic materials such as food products. The dehydration apparatus (10) has a vacuum chamber (12) with a loading module (14) at one end and a discharge module (22) at the other. The vacuum chamber has access doors (80) spaced between the input end (16) and the discharge end (24) which provide operator and maintenance access. Microwave generators (86) are mounted on each access door and arranged to radiate through a microwave chamber and microwave-transparent window on the access door into the vacuum chamber. The waveguides on a respective access door are oriented to minimize microwave interference between the magnetrons on that door. A conveyor (60) in the vacuum chamber moves the organic material (96) on trays (18) through the vacuum chamber.

20 Claims, 4 Drawing Sheets

(51) Int. Cl.
*F26B 5/04* (2006.01)
*H05B 6/78* (2006.01)

(58) Field of Classification Search
CPC . F26B 5/06; F26B 5/065; H05B 6/645; H05B 6/701; H05B 6/704; H05B 6/705; H05B 6/708; H05B 6/72; H05B 6/74; H05B 6/78; H05B 6/782; H05B 6/784; H05B 6/80; H05B 6/806
USPC ..... 219/678, 684, 686, 690, 693, 695, 696, 219/697, 698, 700, 701, 752, 756, 762, 219/763; 34/251, 259, 263, 266, 287
See application file for complete search history.

(56) References Cited

U.S. PATENT DOCUMENTS

| | | | | |
|---|---|---|---|---|
| 4,631,380 | A * | 12/1986 | Tran | A22C 11/006 219/697 |
| 4,746,968 | A | 5/1988 | Wear et al. | |
| 6,442,866 | B2 | 9/2002 | Wefers | |
| 2004/0231184 | A1 | 11/2004 | Wefers | |
| 2010/0072194 | A1 * | 3/2010 | Mackay | H05B 6/782 219/679 |
| 2015/0128442 | A1 * | 5/2015 | Durance | A23C 19/086 34/259 |

FOREIGN PATENT DOCUMENTS

| | | | |
|---|---|---|---|
| WO | 2009033285 | A1 | 3/2009 |
| WO | 2009049409 | A1 | 4/2009 |
| WO | 2011085467 | A1 | 7/2011 |

* cited by examiner

MICROWAVE VACUUM-DRYING OF ORGANIC MATERIALS

BACKGROUND OF THE INVENTION

The invention pertains to apparatuses and methods for microwave vacuum-drying of organic materials, such as food products.

Dehydration of organic materials is commonly done in the food processing industry and in the production of biologically-active materials. It may be done in order to preserve the products for storage, or to create a product that is used in the dehydrated form, for example dried herbs and various kinds of chips. One method employed to dehydrate food products and biologically-active materials is microwave vacuum dehydration. Examples of this in the patent literature include U.S. Pat. No. 6,442,866, Wefers; WO 2009/049409, Durance et al.; WO 2009/033285, Durance et al.; and WO 2011/085467, Fu et al. Microwave vacuum-drying is a rapid method that can yield products with improved quality compared to air-dried and freeze-dried products. Because the drying is done under reduced pressure, the boiling point of water and the oxygen content of the atmosphere are lowered, so food and medicinal components sensitive to oxidation and thermal degradation can be retained to a higher degree than by air-drying. The drying process is also much faster than air- and freeze-drying. However, in some prior art microwave-vacuum driers, substantial disassembly of the apparatus is required to provide access to the interior of the vacuum chamber for purposes of cleaning and repair. In others, relatively high power microwave generators are required, which are expensive and increase the risk of microwave arcing within the vacuum chamber, and thus limit the range of pressures at which the chamber can be operated.

SUMMARY OF THE INVENTION

According to one aspect of the invention, there is provided an apparatus for dehydrating organic material. A vacuum chamber has an input end for introduction of the organic material into the vacuum chamber and a discharge end for removal of the material. The vacuum chamber has a plurality of access doors that are longitudinally spaced apart between the input end and the discharge end of the vacuum chamber, each covering a respective access port. Each access door has a plurality of magnetrons, each magnetron having a respective waveguide. Each access door has a respective microwave-transparent window arranged between the waveguides and the vacuum chamber. The magnetrons and waveguides on a respective access door are arranged to radiate microwaves through the microwave-transparent window into the vacuum chamber. The waveguides on each access door are oriented to minimize microwave interference between the magnetrons on the access door. This minimization of microwave interference may be done by having the waveguide openings in the face of an access door oriented at an angle different from the openings of the other waveguides on the access door. The apparatus has means for reducing pressure inside the vacuum chamber, means for loading the organic material into the input end of the vacuum chamber, means for moving the material through the vacuum chamber from the input end to the discharge end, and means for unloading the dehydrated organic material at the discharge end.

According to another aspect of the invention, there is provided an apparatus for dehydrating organic material, comprising a vacuum chamber having a vacuum chamber access door covering an access port, a plurality of magnetrons positioned on the access door and arranged to radiate microwaves through a microwave-transparent window into the vacuum chamber, each magnetron having a respective waveguide. A microwave-transparent window is arranged between the waveguides and the vacuum chamber. The magnetrons and waveguides on the access door are arranged to radiate microwaves through the microwave-transparent window into the vacuum chamber. The waveguides on the access door are oriented to minimize interference between the magnetrons. The apparatus has means for reducing pressure inside the vacuum chamber.

According to another aspect of the invention, there is provided a method for dehydrating an organic material. The material is introduced into a vacuum chamber, the chamber being at a pressure less than atmospheric. The organic material is moved through the vacuum chamber from an input end to a discharge end while applying microwave radiation from a plurality of magnetrons positioned on a plurality of access doors of the vacuum chamber through respective microwave-transparent windows to dehydrate the organic material, the waveguides being oriented to minimize interference between the magnetrons on a respective access door. The dehydrated organic material is then removed from the vacuum chamber.

According to another aspect of the invention, there is provided a method for dehydrating an organic material. The material is introduced into a vacuum chamber and the pressure in the vacuum chamber is reduced to less than atmospheric. Microwave radiation is applied from a plurality of magnetrons positioned on an access door of the vacuum chamber through a microwave-transparent window into the vacuum chamber to dehydrate the organic material. Each magnetron has a respective waveguide and the waveguides are oriented to minimize microwave interference between the magnetrons. The dehydrated organic material is then removed from the vacuum chamber.

By providing access doors on the vacuum chamber and positioning the microwave generators and microwave-transparent window on the doors, the invention permits operator and maintenance access to the interior of the vacuum chamber and to the microwave generators, without the need for disassembling the dehydration apparatus. The arrangement of the waveguides to minimize interference between the magnetrons on a given access door (i.e. interference between the microwaves produced by each said magnetron) makes it possible to use multiple magnetrons on each door. Such magnetrons can according be relatively low power (and inexpensive) units, which is favorable to the suppression of arcing in the vacuum chamber.

Examples of organic materials suitable for dehydration by the invention include fruit, either whole, puree or pieces, either frozen or un-frozen, including banana, mango, papaya, pineapple, melon, apples, pears, cherries, berries, strawberries, pomegranate, peaches, apricots, plums, grapes, oranges, lemons, grapefruit; vegetables, either fresh or frozen, whole, puree or pieces, including peas, beans, corn, carrots, tomatoes, peppers, herbs, potatoes, beets, turnips, squash, onions, garlic, mushrooms; fruit and vegetable juices; precooked grains including rice, oats, wheat, barley, corn, flaxseed; vegetable gums; drugs; material pieces in which a hydrocolloid or gum surrounds and encapsulates a droplet or particle of a relatively less stable material as a means of protecting and stabilizing the less sensitive material; meats, fish and seafoods, either fresh or frozen, either whole or pieces; dairy products such as cheese and curds.

These and other features of the invention will be apparent from the following description and drawings of the preferred embodiments.

DESCRIPTION OF THE PREFERRED EMBODIMENTS

Figure 1:
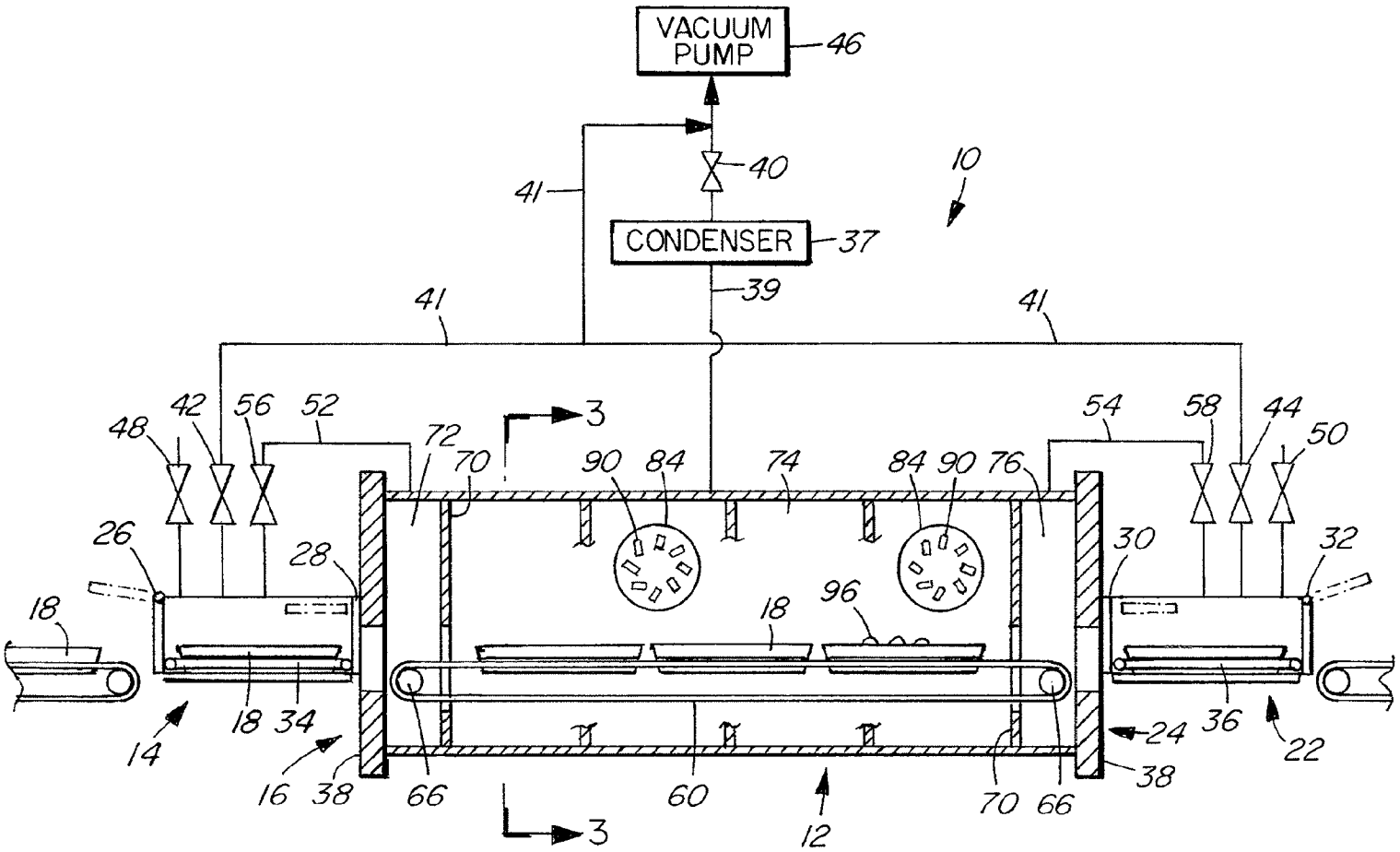
FIG. 1 is a schematic longitudinal section view of a dehydration apparatus according to one embodiment of the invention.

Referring to FIGS. 1 to 4, the dehydrating apparatus 10 has a vacuum chamber 12 through which a tray of organic material is conveyed for dehydration. A loading module 14 is positioned at the input end 16 of the vacuum chamber for introduction of trays 18 of organic material into the vacuum chamber 12. The vacuum chamber is generally cylindrical, with a circumferential side wall 20. A discharge module 22 is positioned at the output or discharge end 24 of the vacuum chamber for removal of the trays. The loading module 14 and discharge module 24 each have a pair of airlock doors, respectively 26, 28 and 30, 32 (their open position being shown by dotted lines in FIG. 1). These permit the trays to be loaded into and unloaded from the vacuum chamber, while maintaining the vacuum chamber at the reduced pressure required for the dehydration process. The loading and discharge modules 14, 24 have motor-driven conveyors 34, 36, respectively, for moving the trays. The dehydration apparatus 10 is oriented with its longitudinal axis substantially horizontal, supported on stands 38.

The vacuum chamber 12 is connected via a shut-off valve 40, a condenser 37 and vacuum conduit 39 to a vacuum pump 46 or the vacuum system of a plant. The loading and discharge modules 14, 22 are connected to the vacuum pump 46 or the vacuum system via a vacuum conduit 41 and shut-off valves 42 or 44. The loading and discharge modules are vented by discharge shut-off valves 48 and 50 respectively. A further discharge valve (not shown) is provided for venting the vacuum chamber. The loading and discharge modules 14, 22 are connected to the vacuum chamber 12 for pressure equalization by means of equalization conduits 52 and 54 and the associated shut-off valves 56 and 58, respectively.

Figure 2:
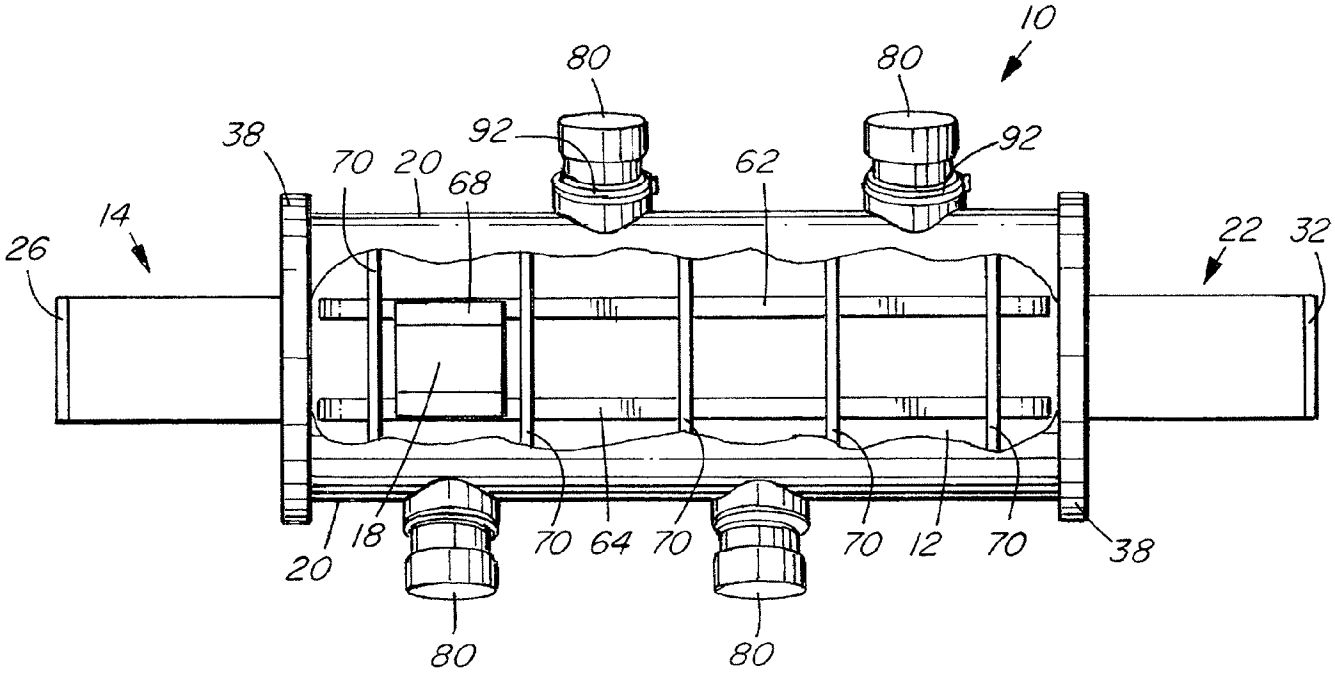
FIG. 2 is a top plan view, partly cutaway, of the apparatus of FIG. 1.
Figure 3:
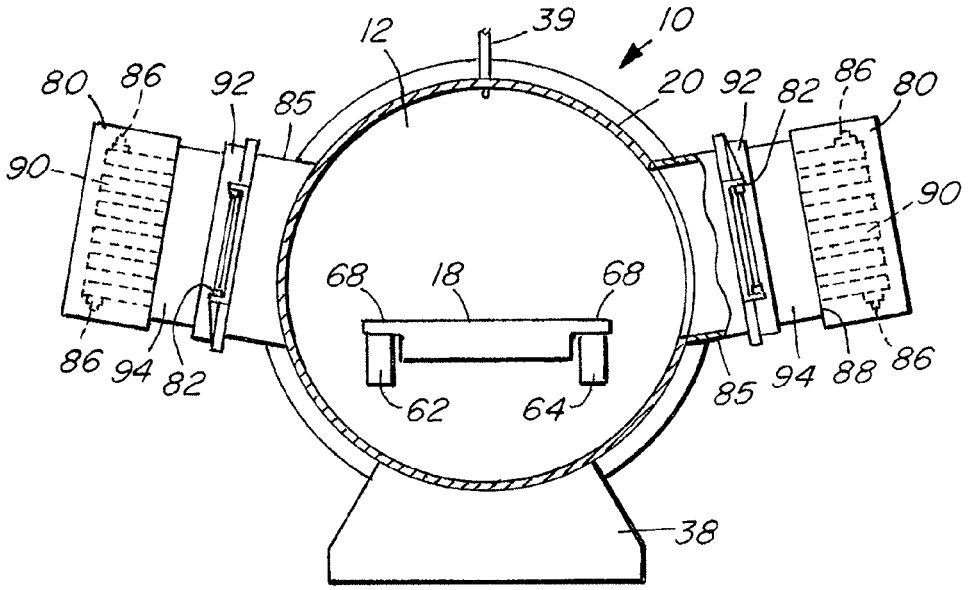
FIG. 3 is a sectional view across the vacuum chamber on the line 3-3 of FIG. 1.

The vacuum chamber 12 has a conveyor 60 extending longitudinally through it and arranged to support and convey the trays 18. The conveyor comprises a pair of spaced-apart belts 62, 64 that run on rollers 66 adjacent to the inlet and the outlet ends of the vacuum chamber. The tray 18 has an outwardly-projecting flange 68 at its upper edge. The tray 18 is supported by its flange 68 on the belts 62, 64, with the body of the tray fitting in the space between the two belts, as best seen in FIGS. 2 and 3. The conveyor 60 is powered by a motor (not shown).

The vacuum chamber is divided by microwave shielding 70 into an inlet zone 72, a treatment zone 74 and a cooling zone 76. The shields 70 are metal plates having slots for the passage of the conveyor 60 and the tray 18. Optionally, the inlet and outlet end shields may be bent parallel to the conveying direction in the region of the passage openings near to the conveyor 60 to keep the inlet and cooling zones 72 and 76 respectively substantially free of microwave radiation.

The vacuum chamber 12 has a plurality of access doors 80 pivotally attached by hinges 82 to opposite sides of the vacuum chamber. Each access door covers an access port 84. There are four access doors 80 in the illustrated embodiment, though it will be understood that the drying apparatus may have any suitable number, depending upon the length and intended capacity of the vacuum chamber. The access doors are positioned in a staggered arrangement on the two lateral sides of the vacuum chamber, as best seen in FIGS. 2 and 3. The access ports have a short open cylindrical channel 85 between the port opening and the side wall 20 of the vacuum chamber 12. These channels are sloped inwardly to aid in drainage of condensate and wash water. The access ports are sized to provide operator and maintenance access to the interior of the vacuum chamber. For example, the access ports may be about 60 cm in diameter on a vacuum chamber having a diameter of about 140 cm. The access doors 80 latch securely and releasably to the vacuum chamber and form an airtight seal with the rim of the ports 84. Within the treatment zone 74, microwave shields 70 are positioned between adjacent access doors.

Figure 4:
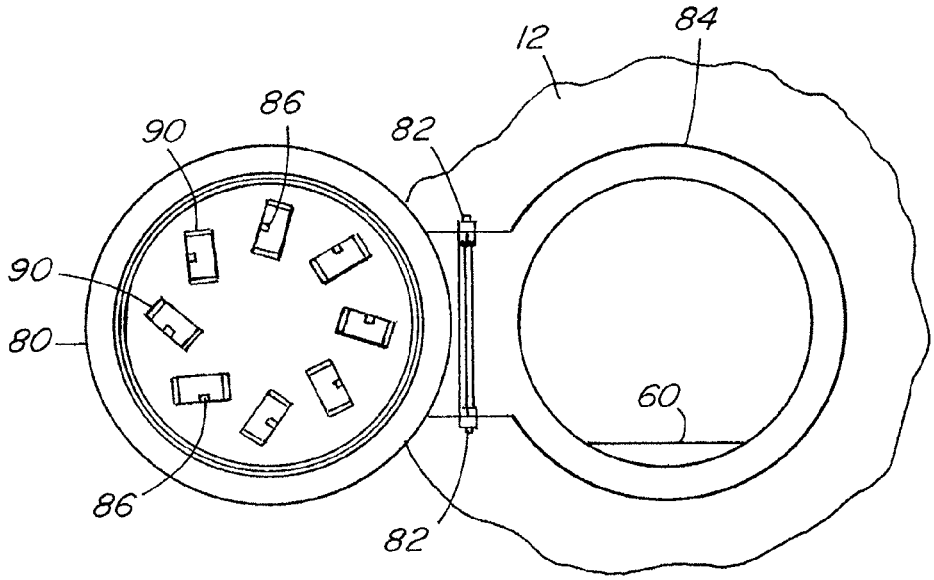
FIG. 4 is an elevational view of a section of the vacuum chamber of the apparatus of FIG. 1, with the access door in the open position.

A set of magnetrons (microwave generators) 86 is mounted inside an inner wall 88 of each access door, with the magnetron antennas protruding into respective waveguides 90. The waveguides are recesses in the inner wall 88 of the access doors, rectangular in elevation view, open at the inner wall or face 88 of the access door and each oriented at an angle different from that of the other waveguides of the access door. The different angles reduce interference between magnetrons, thereby minimizing heating of one magnetron by another, reducing the potential for arcing in the vacuum chamber and resulting in a more uniform microwave field in the vacuum chamber. In the illustrated embodiment, there are eight magnetrons in each access door 80. More or fewer may be provided, depending upon the power and drying requirements for a particular application. As best seen in FIG. 4, the magnetrons 86 and waveguides are arranged in a generally circular array around the face of the door, each oriented at an angle relative to the other magnetrons and waveguides in the set. The magnetrons are connected to a power source (not shown) to provide the required electric power. An exemplary set of magnetrons on each access door comprises eight magnetrons of 1.5 kW each, for a power output of 12 kW for the set. The apparatus as illustrated, having four access doors, would accordingly have a total power output of 48 kW. Coolant is pumped to circulate around the magnetrons from a cooling liquid refrigeration unit (not shown).

A microwave-transparent window 92, made for example of Teflon, is provided on each access door 80 at its inner side, in close proximity to the wall of the vacuum chamber. A microwave chamber 94 is positioned between the magnetrons 86 and the window 92. There is an airtight seal between the window 92 and the access door 80; when the access door is closed and the vacuum chamber is evacuated, the window 92 forms a wall of the vacuum chamber. Outside the window, in the microwave chamber 94, the pressure remains atmospheric.

The dehydration apparatus 10 includes a programmable logic controller (PLC), programmed and connected to control the operation of the system, including the conveyor drive motors, the airlock doors, the microwave generators, the vacuum pump, condenser, the refrigerant pump and the vacuum shut-off valves.

The dehydration apparatus 10 operates according to the following method. The airlock doors 28 and 32 are closed. The vacuum pump, conveyor drive motors and microwave generators are actuated, all under the control of the PLC. Pressure within the vacuum chamber is reduced to a desired pressure, e.g. in the range of 0.01 to 100 Torr (1.333 to 13,332 Pa), alternatively about 0.1 to 30 Torr (13.33 to 4,000 Pa). The organic material 96 to be dehydrated is put into a tray 18 and the tray is placed in the loading module 14. The outer airlock door 26 and shut-off valve 48 are closed and the loading module is evacuated to the pressure of the vacuum chamber. The inner airlock door 28 is then opened and the tray is transported, by the conveyors 34 and 60, into the vacuum chamber 12. Once the tray is fully inside the vacuum chamber, the loading chamber 14 is prepared for receiving a second tray, by closing the inner airlock door 28 and the shut-off valves 42 and 56, and opening the shut-off valve 48 to vent the loading module to atmospheric pressure, and opening the outer airlock door 26. The dehydration apparatus is thus able to process multiple trays of organic material at the same time, in a continuous process. Inside the vacuum chamber 12, the tray is moved along the conveyor 60, from the inlet zone 72 to the treatment zone 74, where the microwave generators 86 irradiate the material and dehydrate it, i.e. reduce its moisture to a desired level. The tray then passes to the cooling zone 76, in which it is allowed to cool. It then enters the discharge module 22, where it is conveyed toward the outer airlock door 32. The inner airlock door 30 is then closed, the shut-off valves 44, 58 are closed, the valve 50 is opened to vent the discharge module to the atmosphere, the outer airlock door 32 is opened and the tray is removed. The discharge module is prepared for the next tray to be removed from the vacuum chamber by closing the outer airlock door 32, evacuating the discharge module to the reduced pressure of the vacuum chamber, and opening the inner airlock door 30. Following either loading or discharge of a tray from the loading modules or discharge module, the shut-off value 40 can be momentarily closed and the vacuum pump can draw gases directly from the loading or discharge module, through the vacuum conduit 41, without disturbing the vacuum in the vacuum chamber 12.

Figure 5:
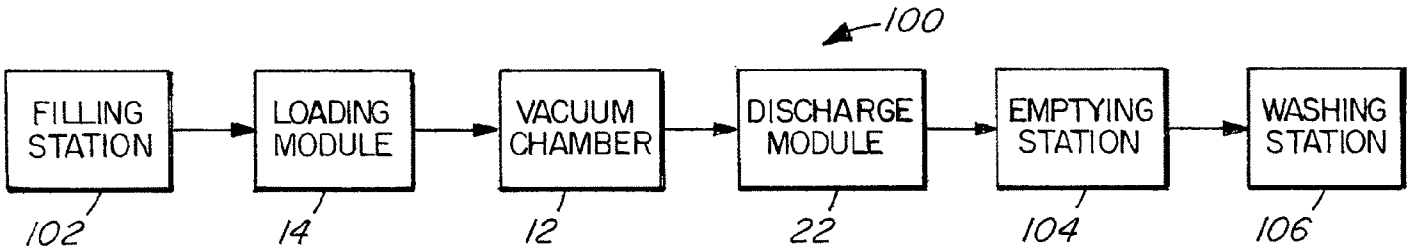
FIG. 5 is a schematic view of a production line incorporating the dehydration apparatus of FIG. 1.

As shown in FIG. 5, the dehydration apparatus 10 may be incorporated into a production line 100. The vacuum chamber 12, the loading module 14 and discharge module 22 are arranged together as described above. Upstream of the loading module 14 is a filling station 102 for filling the trays with organic material to be dehydrated. The filled trays are then conveyed to the loading module 14. An emptying station 104 for emptying the trays of their dehydrated contents is downstream of the discharge module 22, optionally followed by a washing station 106 for washing the emptied trays.

Optionally, and as a matter of manufacturing and operational convenience, the vacuum chamber may be built of separate vacuum chamber modules. Such a module comprises a longitudinal section of the vacuum chamber having an access door 80 and access port 84, the modules being configured to connect together end-to-end in an airtight mating attachment. A vacuum chamber can be built to any desired length or capacity using standard modules. Transportation of the drying apparatus from the manufacturer to the user for assembly is facilitated by modular design, and a damaged module can be repaired without substantially affecting the rest of the apparatus.

Figure 7:
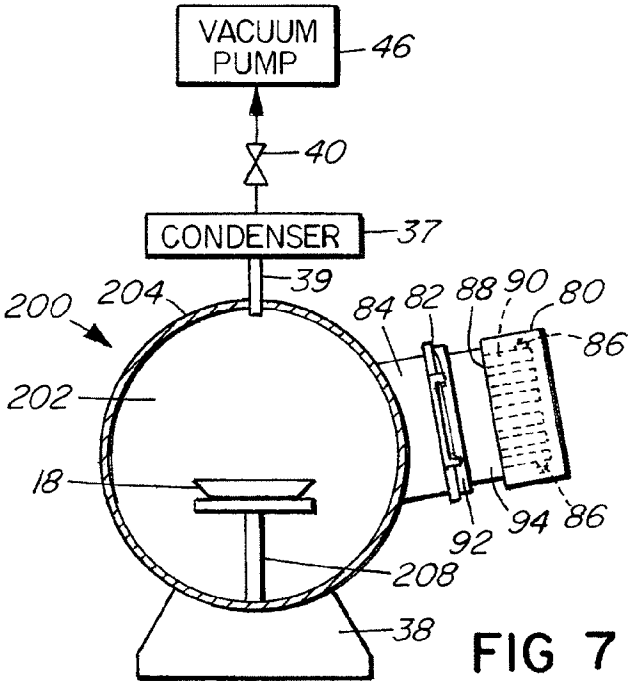
FIG. 7 is sectional view across the apparatus of FIG. 6.
Figure 6:
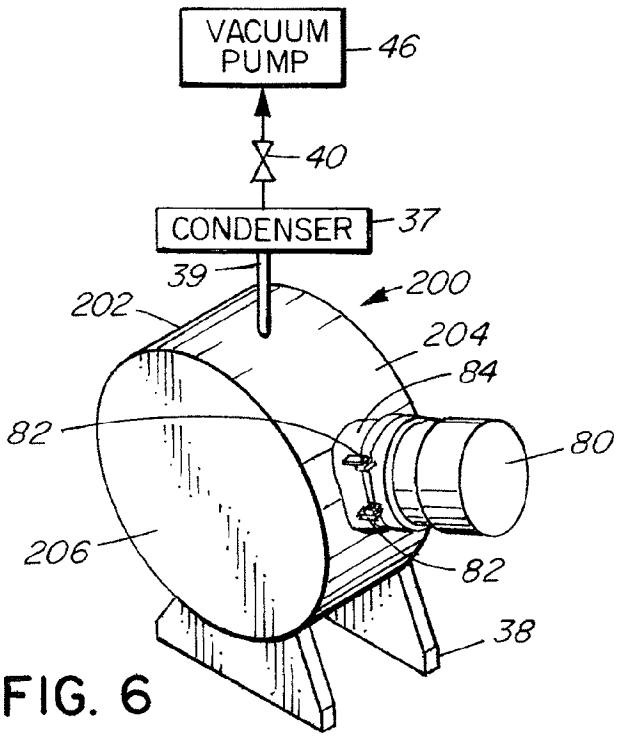
FIG. 6 is a perspective view of an embodiment of the dehydration apparatus for batch production.

The invention also includes a dehydration apparatus and method in which there is a single access door to the vacuum chamber, rather than the multiple ones as described above. Referring to FIGS. 6 and 7, a dehydration apparatus 200 comprises a vacuum chamber 202 having a cylindrical side wall 204 and end walls 206, and having a single access door 80 with a set of microwave generators 86 and microwave-transparent window 92. The dehydration apparatus 200 is substantially the same as the apparatus 10 as described above, except that it does not have means to convey the tray of organic material through the vacuum chamber 202, and is not adapted for connection to a loading module or discharge module, these modules not being required as the access door 80 is to be opened to load and unload the tray of organic material. Nor is the vacuum chamber divided into sections by microwave shielding 70, as in apparatus 10. The drying apparatus 200 is accordingly intended for batch drying rather than a continuous process. The tray 18 of organic material to be dehydrated is placed onto a stand 208 in the vacuum chamber 202 through the access port 84. The access door 80 is then sealed and the vacuum chamber is evacuated. After dehydration, the vacuum chamber is vented to the atmosphere, the access door is opened and the tray of dehydrated materials is removed. Such operation may be mechanized or done manually by an operator.

Throughout the preceding description and the drawings, in which corresponding and like parts are identified by the same reference characters, specific details are set forth in order to provide a more thorough understanding to to persons skilled in the art. However, well known elements may not have been shown or described to avoid unnecessary detail. Accordingly, the description and drawings are to be regarded in an illustrative, rather than a restrictive, sense. The scope of the invention is defined by the claims which follow.

The invention claimed is:

1. An apparatus for dehydrating organic material, comprising: a vacuum chamber having an input end for introduction of the organic material into the vacuum chamber and a discharge end for removal of the organic material; the vacuum chamber having a plurality of access doors each access door covering a respective access port into the vacuum chamber, the access doors being longitudinally spaced apart along the vacuum chamber between the input end and the discharge end; each said access door having a plurality of magnetrons, each magnetron having a respective waveguide; each said access door having a respective microwave-transparent window arranged between the waveguides and the vacuum chamber; the plurality of magnetrons and waveguides on a respective access door being arranged to radiate microwaves through the microwave-transparent window into the vacuum chamber; the waveguides on a respective access door being oriented to minimize microwave interference between the magnetrons on said access door; means for reducing pressure inside the vacuum chamber; means for loading the organic material into the input end of the vacuum chamber; means for moving the organic material through the vacuum chamber from the input end to the discharge end thereof; and means for unloading the dehydrated organic material from the vacuum chamber at the discharge end thereof.

2. The apparatus according to claim 1, wherein each waveguide has an opening in a face of a respective access door, each opening being oriented at an angle different from the openings of the other waveguides on said access door.

3. The apparatus according to claim 1, wherein the access doors are positioned in a staggered arrangement along opposed sides of the vacuum chamber, with longitudinally-adjacent access doors being positioned on opposed sides of the vacuum chamber.

4. The apparatus according to claim 1, wherein the access doors are pivotally attached to the vacuum chamber.

5. The apparatus according to claim 1, wherein each microwave- transparent window is mounted on a respective access door.

6. The apparatus according to claim 1, wherein the magnetrons on each access door are arranged in a generally circular array.

7. The apparatus according to claim 1, wherein the access ports comprise an open channel between each respective access port opening and the side wall of the vacuum chamber, and the channels slope downward from the respective access port opening to the side wall.

8. The apparatus according to claim 1, further comprising a microwave chamber between the magnetrons on a respective access door and the respective microwave-transparent window, the microwave chamber being adapted to be at atmospheric pressure.

9. The apparatus according to claim 1, wherein the means for moving the organic material comprises a conveyor arranged to transport a tray of the organic material.

10. The apparatus according to claim 9, wherein the conveyor comprises a pair of spaced-apart belts that engage a flange of the tray.

11. The apparatus according to claim 1, wherein the means for loading and the means for unloading comprise air locks.

12. The apparatus according to claim 1, wherein the vacuum chamber comprises a plurality of vacuum chamber modules connected together end-to-end and each said module has a respective access door.

13. The apparatus according to claim 1, further comprising microwave shields in the vacuum chamber between adjacent access doors.

14. The apparatus according to claim 1, wherein the dehydration apparatus further comprises an emptying station for emptying the tray of dehydrated material, a washing station for washing the emptied tray and a filling station for filling the washed container with the organic material to be dehydrated.

15. An apparatus for dehydrating organic material, comprising: a vacuum chamber; a vacuum chamber access door covering an access port into the vacuum chamber; the access door having a plurality of magnetrons, each magnetron having a respective waveguide; a microwave- transparent window arranged between the waveguides and vacuum chamber; the plurality of magnetrons and waveguides on the access door being arranged to radiate microwaves through the microwave-transparent window into the vacuum chamber; the waveguides being oriented to minimize microwave interference between the magnetrons on the access door; and means for reducing pressure inside the vacuum chamber.

16. The apparatus according to claim 15, wherein each waveguide has an opening in a face of the access door, each opening being oriented at an angle different from the openings of the other waveguides on the access door.

17. The apparatus according to claim 15, further comprising a microwave chamber between the magnetrons and the microwave-transparent window, the microwave chamber being adapted to be at atmospheric pressure.

18. A method for dehydrating an organic material, comprising the steps of:

introducing the organic material to be dehydrated into a vacuum chamber; reducing pressure in the vacuum chamber to a pressure less than atmospheric; applying microwave radiation from a plurality of magnetrons positioned on an access door of the vacuum chamber through a microwave-transparent window into the vacuum chamber to dehydrate the organic material, each magnetron having a respective waveguide, the waveguides being oriented to minimize microwave interference between the magnetrons; and removing the dehydrated organic material from the vacuum chamber.

19. The method according to claim 18, wherein the microwave radiation from the magnetrons passes through a microwave chamber at atmospheric pressure before passing through the microwave-transparent window into the vacuum chamber.

20. The method according to claim 18, further comprising, prior to the steps of removing the dehydrated organic material from the vacuum chamber, the step of moving the organic material through the vacuum chamber from an input end to a discharge end while applying microwave radiation from magnetrons positioned on a plurality of access doors of the vacuum chamber through a respective microwave-transparent window into the vacuum chamber to dehydrate the organic material, each magnetron having a respective waveguide, the waveguides on a respective access door being oriented to minimize microwave interference between the magnetrons on said access door.

* * * * *